US009388755B2

(12) United States Patent
Jessen et al.

(10) Patent No.: US 9,388,755 B2
(45) Date of Patent: Jul. 12, 2016

(54) METHOD FOR OPERATING AN INTERNAL COMBUSTION ENGINE HAVING A PLURALITY OF CYLINDERS IN HOMOGENEOUS OPERATION

(71) Applicant: Robert Bosch GmbH, Stuttgart (DE)

(72) Inventors: Holger Jessen, Ludwigsburg (DE); Wolfgang Tiebel, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 276 days.

(21) Appl. No.: 14/065,227

(22) Filed: Oct. 28, 2013

(65) Prior Publication Data

US 2014/0121950 A1 May 1, 2014

(30) Foreign Application Priority Data

Oct. 29, 2012 (DE) ..... 10 2012 219 725

(51) Int. Cl.
*F02D 41/00* (2006.01)
*F02D 41/14* (2006.01)

(52) U.S. Cl.
CPC ..... *F02D 41/0085* (2013.01); *F02D 41/1408* (2013.01); *F02D 41/1498* (2013.01); *F02D 41/1454* (2013.01); *F02D 2200/101* (2013.01)

(58) Field of Classification Search
CPC . F02B 2075/125; F02D 41/00; F02D 41/008; F02D 41/3029; F02D 41/402; F02D 41/1498; F02D 2200/1015; Y02T 10/44
USPC ..... 701/101–105, 109, 111, 114; 123/295, 123/299, 406.16, 406.18, 406.28, 406.33; 73/23.32, 114.02, 114.32, 114.42, 73/114.48, 114.72
See application file for complete search history.

(56) References Cited

U.S. PATENT DOCUMENTS 5,806,304 A * 9/1998 Price ..... F01N 3/2006 123/339.19
6,062,071 A * 5/2000 Henn ..... G01P 21/02 73/114.04
6,748,315 B2 * 6/2004 Galtier ..... G01M 15/11 123/198 F
6,792,913 B1 * 9/2004 Oder ..... F02D 41/1475 123/295
6,935,313 B2 * 8/2005 Jacobson ..... F02D 35/023 123/406.22
7,607,345 B2 * 10/2009 Katayama ..... G01M 15/11 123/406.14

(Continued)

FOREIGN PATENT DOCUMENTS

DE 4319677 12/1994
DE 19527218 6/1996
DE 19733958 2/1999

(Continued)

*Primary Examiner* — John Kwon
*Assistant Examiner* — Johnny H Hoang
(74) *Attorney, Agent, or Firm* — Norton Rose Fulbright US LLP

(57) ABSTRACT

A method is described for operating an internal combustion engine, having a plurality of cylinders in an homogeneous operation, in which an exhaust gas lambda value and an unsteady running of the internal combustion engine are recorded, a mixture composition being cyclically varied, at least intermittently. In a test operation, the mixture composition is cyclically varied, in a selected cylinder, about a determined lambda value, whereas meanwhile the mixture composition is held constant in the remaining cylinders. From the magnitude of a cyclical fluctuation of the unsteady running or of a variable characterizing this, one may conclude upon a trimming of the mixture composition in the selected cylinder.

11 Claims, 5 Drawing Sheets

(56) References Cited

U.S. PATENT DOCUMENTS

| | | | | |
|---|---|---|---|---|
| 8,272,361 | B2 * | 9/2012 | Porten | F02D 41/0085 123/294 |
| 2007/0056553 | A1 * | 3/2007 | Kohler | F02B 23/101 123/295 |

FOREIGN PATENT DOCUMENTS

| | | |
|---|---|---|
| DE | 102004010412 | 9/2005 |
| DE | 102007020964 | 11/2008 |
| EP | 0629775 | 12/1994 |
| EP | 0929794 | 7/1999 |

* cited by examiner

METHOD FOR OPERATING AN INTERNAL COMBUSTION ENGINE HAVING A PLURALITY OF CYLINDERS IN HOMOGENEOUS OPERATION

FIELD OF THE INVENTION

The present invention relates to a method, a computer program, and at least one of a control and a regulating device for operating an internal combustion engine having a plurality of cylinders in homogenous operation.

BACKGROUND INFORMATION

Methods for the coordination of cylinders of an internal combustion engine are known from the related art. This takes place while using a signal of a lambda probe in the exhaust system of the internal combustion engine, from which, in some instances, deviations in the mixture composition may be ascertained. Rotational speed-based methods are also known, in which unevenesses of an engine speed are ascertained for the purpose of achieving the coordination of the torque over all the cylinders of the internal combustion engine. Patent publications from this special field are, for example, German Published Patent Appln. No. 10 2007 020 964, German Published Patent Appln. No. 195 27 218, German Patent No. 43 19 677, German Published Patent Appln. No. 10 2004 010 412, German Published Patent Appln. No. 197 33 958, and European Patent Specification 0 929 794.

SUMMARY

An object on which the present invention is based is attained by a method as well as by a computer program and a control and/or regulating device. Features for the present invention are also found in the following description and in the drawings, the features being able to be essential for the present invention both alone and also in different combinations, without further explicit reference being made to it.

The present invention has the advantage that a lambda value of an exhaust gas of an internal combustion engine is able to be corrected very simply on a basis individual to each cylinder, without having to intervene actively in the combustion process in the combustion chambers of the internal combustion engine. An overall air/fuel ratio does not have to be additionally changed ("trimmed") according to the present invention. In particular, a sequential leaning of cylinders of the internal combustion engine is not required. Faulty injection quantities of fuel into the cylinders of the internal combustion engine are able to be detected, emissions of pollutants in the exhaust gas during carrying out the method not being increased, or only slightly so. In addition, the method according to the present invention is also able to be carried out in a comparatively short time for internal combustion engines having more than four cylinders.

The present invention relates to operating an internal combustion engine having a plurality of cylinders in homogeneous operation, in which an exhaust gas lambda value and an unsteady running of the internal combustion engine are recorded, the mixture composition being cyclically varied. According to the present invention, in a test operation, the mixture composition is cyclically varied, in a selected cylinder, about a determined lambda value, whereas meanwhile the mixture composition is held constant in the remaining cylinders. Furthermore, according to the present invention, from the magnitude of a cyclical fluctuation of the unsteady running or of a variable characterizing it, one may conclude upon a trimming of the mixture composition in the selected cylinder.

The test operation includes an actively utilized operation of the internal combustion engine, for instance, a driving operation of a motor vehicle. The present invention makes use of the fact that modern internal combustion engines are able to control the mixture composition or the composition of the exhaust gas using a lambda probe in connection with a so-called two-position control or a so-called continuous control. If an exhaust system of the internal combustion engine includes a plurality of lambda probes, that particular lambda probe is preferably used which is situated the farthest upstream. In this context, there takes place, within the scope of a continuous "conditioning" of the exhaust gas, an, in general, periodic change between an enrichment and a leaning of the fuel/air mixture supplied to the internal combustion engine. The present invention utilizes the lambda regulation or the lambda control system, that is present anyhow, for the diagnosis of air or fuel quantitative errors in the respective currently selected cylinder. The present invention particularly provides that respective cyclical changes of the mixture composition take place only for the respectively selected cylinder. In the remaining, currently not selected cylinders of the internal combustion engine, at the same time no cyclical changes of the mixture composition are stimulated or admitted. In short, the mixture composition is held constant there. It is thereby possible to achieve a higher signal amplitude, corresponding to the change of a periodic enrichment and leaning of the fuel/air mixture, in the lambda control circuit than would be the case in response to simultaneous changes on all cylinders of the internal combustion engine. The accuracy of the method according to the present invention is thereby also able to be increased. The change in the unsteady running of the internal combustion engine, as a result of the respective sudden enriching or leaning, is subsequently evaluated and, if applicable, is used for a correction individual for each cylinder of the mixture composition, as will be described below.

The cyclical change of the mixture composition in the respectively selected cylinder means correspondingly cyclical jumps with respect to an enrichment or a leaning of the fuel/air mixture. At least in response to the abovementioned "continuous lambda control", a so-called "forced amplitude", that is, a stimulation is impressed upon the lambda control circuit. In the so-called "two-position control", it may perhaps be sufficient to utilize the natural oscillation of the two-position control circuit, so that in this case perhaps no special impressing of a forced amplitude is required. The two-position lambda control generally takes place in such a way that, if, in the exhaust gas, a respective transition is detected from a too rich mixture, towards a lean one or from a lean mixture towards a rich one, an operating direction of the control variable of the two-position lambda control is abruptly changed. The cylinders of the internal combustion engine, that are each currently not acted upon by the method, are preferably controlled to a neutral level having a lambda value of 1. Using this method, one is able to achieve that, for example, in the case of an internal combustion engine having four cylinders, the abrupt change in the lambda value of the selected cylinders is able to be increased fourfold with respect to normal operation, in which an abrupt change in the lambda value takes place in all cylinders. Thereafter, the method according to the present invention may be applied, in the same manner, to the remaining cylinders of the internal combustion engine, one after another. Consequently, a possible exhaust gas-deteriorating unequal distribution of the lambda values individual to each cylinder is able to be detected and then removed.

One embodiment of the method provides that the determined lambda value be approximately 1. In this way, the variation of the mixture composition in the respectively selected cylinder takes place about an average lambda value of 1. Thus it is achieved that the lambda value of the selected cylinder has the value 1, on average, and a respective increase (leaning) or a reduction (enrichment) of the lambda value takes place periodically for a short time, only because of the variation. Because of this, a deterioration of the exhaust gas emissions during the carrying out of the method is able to be reduced or even totally avoided.

The mixture composition of the remaining cylinders is preferably held constant at a lambda value of 1 in the test operation. It is thereby achieved that the lambda values for the remaining cylinders are also set in optimum fashion, whereby harmful exhaust gas emissions are minimized.

Another embodiment of the method provides that the amplitude of the variation of the mixture composition, in the test operation, for the respectively selected cylinder and for an n-cylinder internal combustion engine is the n-fold multiple of the amplitude of a variation of all cylinders. Because of the increase, achieved thereby, of the signal amplitude in the control system, the accuracy of the method according to the present invention is able to be clearly improved.

It may furthermore be provided that, in the test operation, a first unsteady running average value of a plurality of unsteady running values be formed, which are associated with a respective phase having a relatively rich mixture composition, and a second unsteady running average value of a plurality of unsteady running values be formed, which are associated with a respective phase having a relatively lean mixture composition, a difference of the two unsteady running average values be formed, this difference be compared to at least one threshold value, and, from the result of the comparison, a conclusion is drawn on the trimming of the mixture composition in the selected cylinder. Because of the formation of the first and the second unsteady running average value, the accuracy of the method is able to be clearly improved, for instance in that interferences, which are aperiodic to the cyclical variation of the mixture composition, according to the present invention, are filtered out.

An evaluation of the difference preferably takes place in such a way that, if the difference is less than a lower threshold value, one may conclude upon (i.e., infer or determine) a selected cylinder trimmed towards rich, and if the difference is greater than an upper threshold value, one may conclude upon a selected cylinder trimmed towards lean. In this instance, the present invention utilizes a connection previously known per se, between a lambda value of the exhaust gas and an unsteady running in an Otto engine combustion ("lambda fish hook curve"). This yields that the unsteady running in a rich range of the fuel/air mixture (lambda value<1) in response to a variation of the mixture composition is hardly changed. By contrast, the unsteady running in a lean range (lambda>1) is changed all the more in response to the variation of the mixture composition, the leaner the mixture composition is. This makes the method according to the present invention particularly effective and this will be described in greater detail below, regarding FIG. 2.

One application of the method provides that the trimming ascertained of the selected cylinder is used to correct a fuel quantity that is to be injected and/or an air quantity of the selected cylinder of the internal combustion engine. In general, a lambda value of 1 is aimed for, in this context, whereby the fuel consumption lowered, and the exhaust gas is able to be improved. The correction of the selected cylinder preferably takes place without delay, i.e. before additional cylinders of the internal combustion engine have been submitted, one after the other, to the method according to the present invention. Thereby the exhaust gas of the internal combustion engine is additionally improved.

It is particularly favorable if the method according to the present invention is carried out at least partially using a computer program, which is run on a control and/or regulating device for the internal combustion engine. Thereby, effort and costs may be saved.

DETAILED DESCRIPTION

Figure 1:
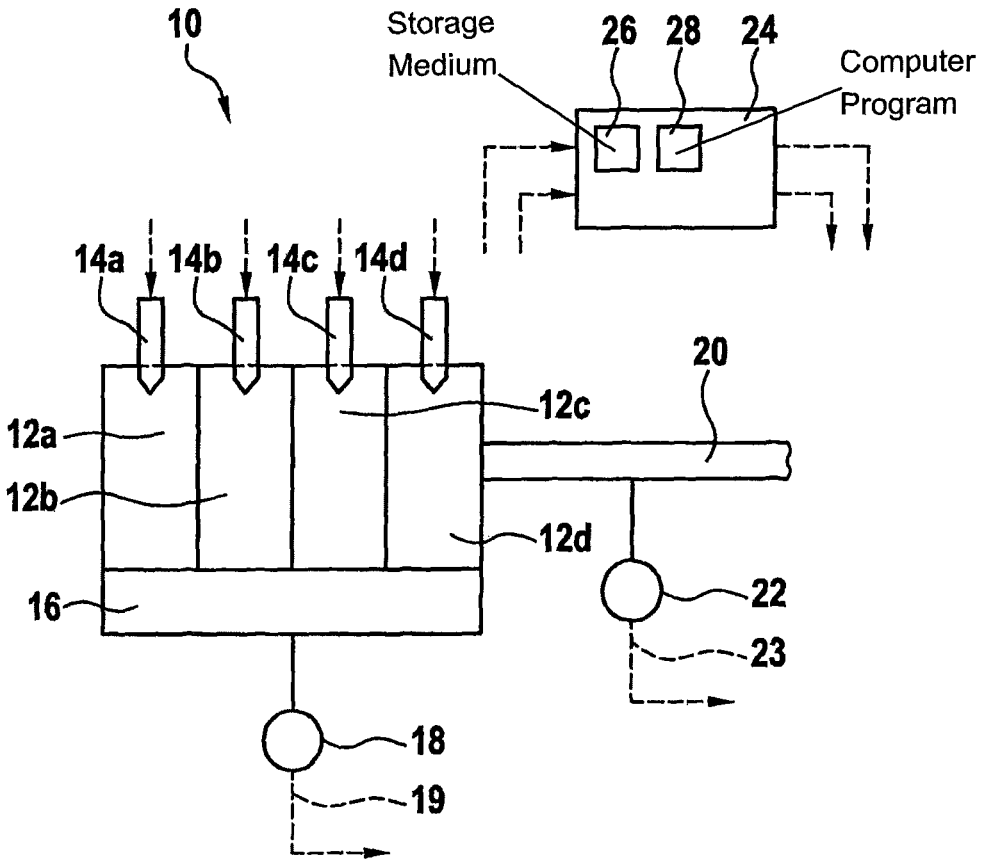
FIG. 1 shows a simplified diagrammatic representation of an internal combustion engine and an exhaust system.

The same reference numerals are used, even in different specific embodiments, for functionally equivalent elements and variables in all the figures.

FIG. 1 shows a simplified diagrammatic representation of an internal combustion engine 10 having presently four cylinders 12*a*, 12*b*, 12*c* and 12*d*, and associated injectors 14*a*, 14*b*, 14*c* and 14*d* for the injection of fuel. Internal combustion engine 10 is designed as a gasoline engine. The four cylinders 12*a*, 12*b*, 12*c* and 12*d* work on a crankshaft 16 drawn schematically below them, a sensor 18 of a signal-generating wheel (not shown), recording an instantaneous angle of rotation of crankshaft 16. Sensor 18 produces a rotational speed signal 19.

An exhaust pipe 20 ("exhaust system") guides the exhaust gases of the four cylinders 12*a*, 12*b*, 12*c* and 12*d* away, whose lambda value 30 (see FIG. 2) is recorded by a lambda probe 22. At one electric terminal of lambda probe 22 a lambda signal 23 is output.

In the right upper part of FIG. 1, a control and/or regulating device 24 is shown, together with indicated outgoing and incoming control lines, as well as an electrical storage medium 26 and a computer program 28 included therein. Among other things, rotational signal 19 and lambda signal 23 of control and/or regulating device 24 are also supplied. Control and/or regulating device 24 is able to ascertain, from rotational signal 19, for each power stroke and each cylinder 12, a torque individual to each power stroke and cylinder.

Figure 2:
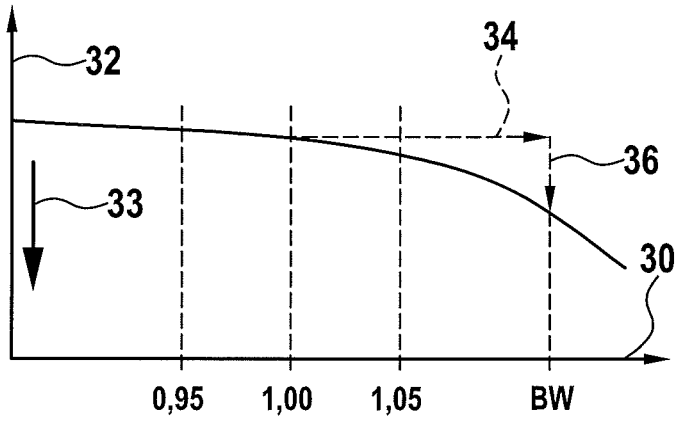
FIG. 2 shows a diagram showing running smoothness as a function of a lambda value.

FIG. 2 graphically shows a connection ("lambda fish hook curve") between a lambda value 30 and a running smoothness 32 of internal combustion engine 10. On the abscissa of the coordinate systems shown in FIG. 2, lambda value 30 is plotted, and on the ordinate, running smoothness 32 is plotted. The lambda values 30 shown characterize a respective mixture composition, which is supplied to cylinders 12*a* to 12*d* periodically corresponding to the power stroke of internal combustion engine 10.

Big lambda values 30 (air excess) characterize a comparatively lean mixture composition, and small lambda values 30 characterize a comparatively rich mixture composition. Large values of running smoothness 32 correspond to a comparatively high combustion torque of internal combustion engine 10. Small values of running smoothness 32 correspond to a comparatively small combustion torque of internal combustion engine 10.

One should observe that, instead of the "running smoothness" used in FIG. 2, in FIGS. 3 through 5, described below, the term "unsteady running" is used. In FIG. 2, for a better comparison, an unsteady running 33 is shown, using an arrow parallel to the ordinate.

In the present diagram, the abscissa is scaled using lambda values 30 of 0.95, 1.00, 1.05 and a value EV ("exemplary value"). It may be seen that, with increasing lambda values 30, running smoothness 32 drops off monotonically.

Starting from a lambda value 30 of 1.00 in the middle of the diagram shown, and going towards exemplary value EV, a differential lambda value 34 may be given which, in FIG. 2, is shown by a horizontal directional arrow. Differential lambda value 34 at the same time characterizes a respective amplitude of a variation of the mixture composition, cf. FIGS. 3 and 4, for this. Thus, in the present instance, the amplitude varies between a lower lambda value 30 of 1.00 and an upper lambda value 30 corresponding to EV. Fitting with this, a differential running smoothness 36 is given in FIG. 2, which is shown by a vertical directional arrow.

As may be seen in the drawing, the drop in running smoothness 32 for exemplary value EV is comparatively large. If, on the other hand, and deviating from the example shown, the change in the mixture composition from lambda value 0.95 to 1.05 were to take place (which would correspond approximately to an equally large differential lambda value 34), associated differential running smoothness value 36 would be comparatively small. However, this is not shown in FIG. 2, for clarity's sake.

In FIG. 2 one may also see that a, preferably periodic, change in lambda value 30 leads to a correspondingly periodic change in running smoothness 32. In this context, it is obvious that the respective change in running smoothness 32 is the smaller, the more a respective average value of lambda value 30 is located in the direction of a rich mixture composition.

Figure 3:
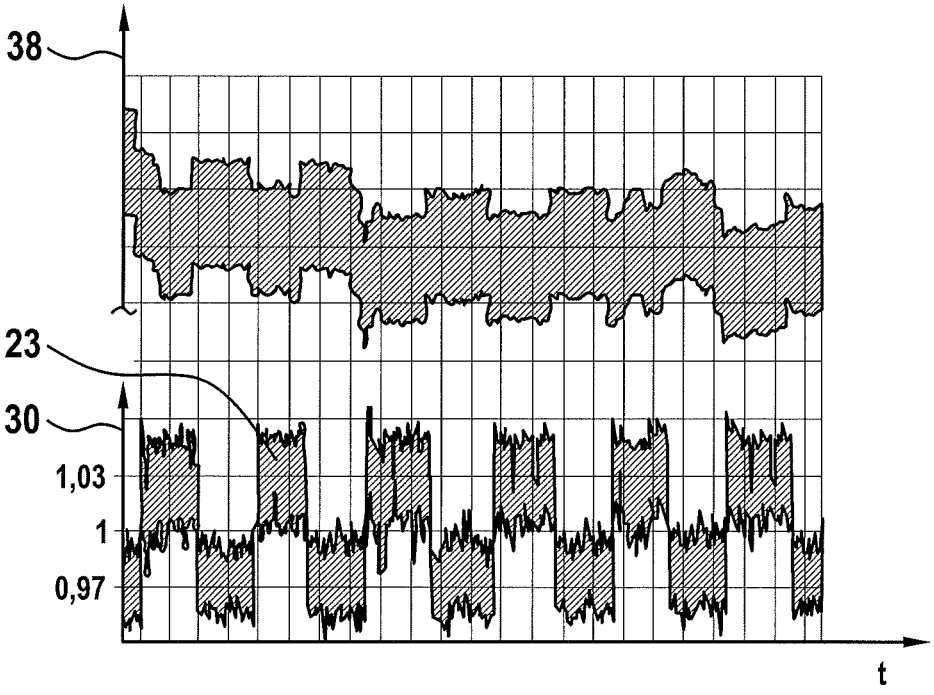
FIG. 3 shows a diagram over time having a signal characterizing an injection duration and an associated lambda signal.

FIG. 3 shows a diagram over time against lambda signal 23 and an associated injection period 38. On the abscissa of the coordinate system shown, a time t is plotted, and on a lower ordinate in the drawing, lambda value 30 is plotted and on an upper ordinate in the drawing, injection period 38 is plotted. Respective zero values for lambda signal 23 and injection period 38 in the drawing are far below the abscissa, and are not visible in the present diagram.

A time period shown along the abscissa in the present diagram includes about 20 seconds. Accordingly, finer structures in the imaged curves for lambda signal 23 and injection period 38 are not visible or only sketched, because of the resulting resolution. Presently, an average value of lambda signal 23 corresponds to a lambda value 30 of one.

Presently, lambda signal 23 has abrupt changes with respect to lambda values 30 between about 0.97 and 1.03. The changes take place periodically approximately every 2 seconds. The illustration in FIG. 3 is based on a control circuit which in the present case is characterized by a so-called "two-position regulation", and in which case injection period 38 is changed as a function of lambda signal 23. This takes place using a sign such that the periodic behavior shown is yielded.

A comparatively smaller lambda value 30 corresponds, as described, to a comparatively rich mixture composition, and consequently, as shown in the drawing of FIG. 3, to a relatively large injected fuel quantity or a relatively long injection period 38. The same applies in reverse.

Figure 4:
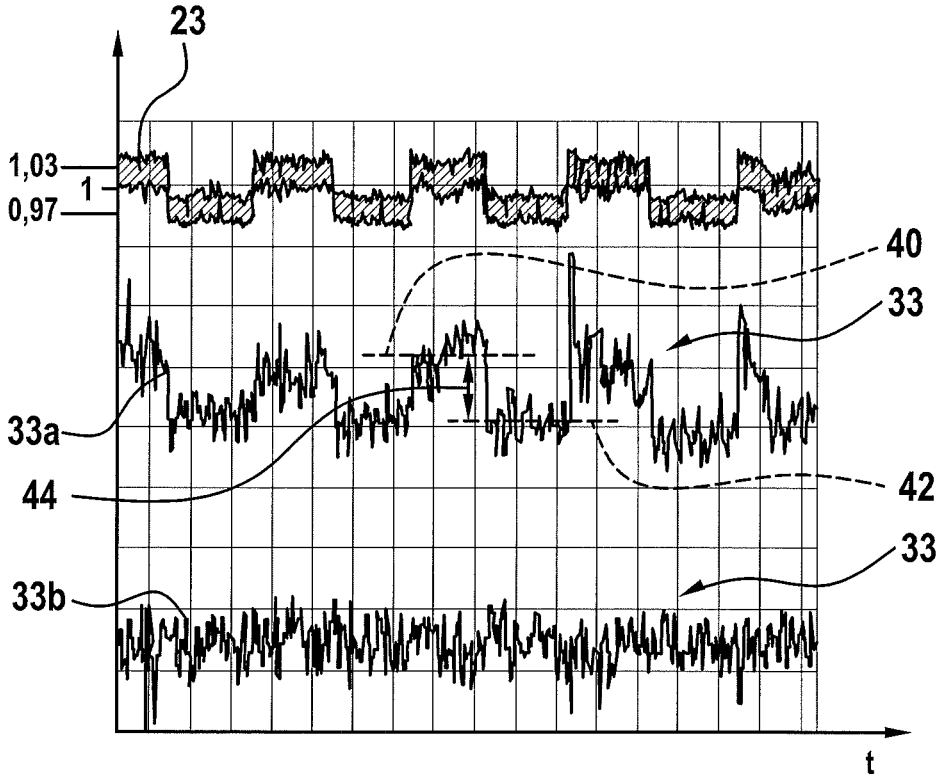
FIG. 4 shows a diagram over time having the lambda signal and two signals characterizing the unsteady running.

FIG. 4 shows a diagram over time, having lambda signal 23 in an upper area of the drawing, a first unsteady running signal 33*a* in a middle area of the drawing, and a second unsteady running signal 33*b* in a lower area of the drawing. Unsteady running signal 33*a* and 33*b* are (electrical) variables that characterize the respective unsteady running 33. The formation of unsteady running signals 33*a* and 33*b* takes place, using methods known from the related art, from rotational speed signal 19, and is not explained here in greater detail.

Time t is plotted along the abscissa of the coordinate system shown in FIG. 4. The ordinate is used for lambda signal 23 and unsteady running signal 33*a* and 33*b* in common. In one area of lambda signal 23, the ordinate in FIG. 4 is scaled similar to FIG. 3, having lambda values 0.97, 1 and 1.03.

One may see that unsteady running signal 33*a* has comparatively large fluctuations in the rhythm of lambda signal 23, as compared to unsteady running signal 33*b*. Accordingly, in this case, the mixture composition varies periodically between relatively rich and relatively lean ranges. One may see, by comparison with the diagram of FIG. 2, that unsteady running signal 33*a* in total corresponds to a comparatively lean mixture composition of respectively selected cylinder 12. Correspondingly, unsteady running signal 33*b* is characterized by an overall comparatively rich mixture composition.

Corresponding to the cyclical changes of lambda signal 23 and lambda value 30, for unsteady running signal 33*a*, a first unsteady running average value 42 and a second unsteady running average value 40 are able to be ascertained. For this, see the horizontal dashed lines in the drawing of FIG. 4. A difference 44 may be stated on first unsteady running average value 42 and second unsteady running average value 40. Difference 44, in this case, represents the magnitude of a cyclical fluctuation of unsteady running 33.

As one may see, difference 44 is comparatively large, and corresponds, as was mentioned before, to an overall comparatively lean operation of respectively selected cylinder 12. From the magnitude of the cyclical fluctuations of unsteady running 33 and unsteady running signals 33*a* and 33*b*, one may conclude that there has been trimming in respectively selected cylinder 12.

For unsteady running signal 33*b* in the lower area of the coordinate system one could also define a first and a second unsteady running average value (not shown). As may be recognized from the time curve in FIG. 4, the fluctuations in unsteady running signal 33*b* with respect to possible differences of first and second unsteady running average values 42 and 40 that are to be ascertained are, however, so slight that difference 44 cannot be shown as far as drawing technique is concerned. Difference 44 of first unsteady running signal 33*a* may, however, be compared to a threshold value 46 (see FIG. 5).

Figure 5:
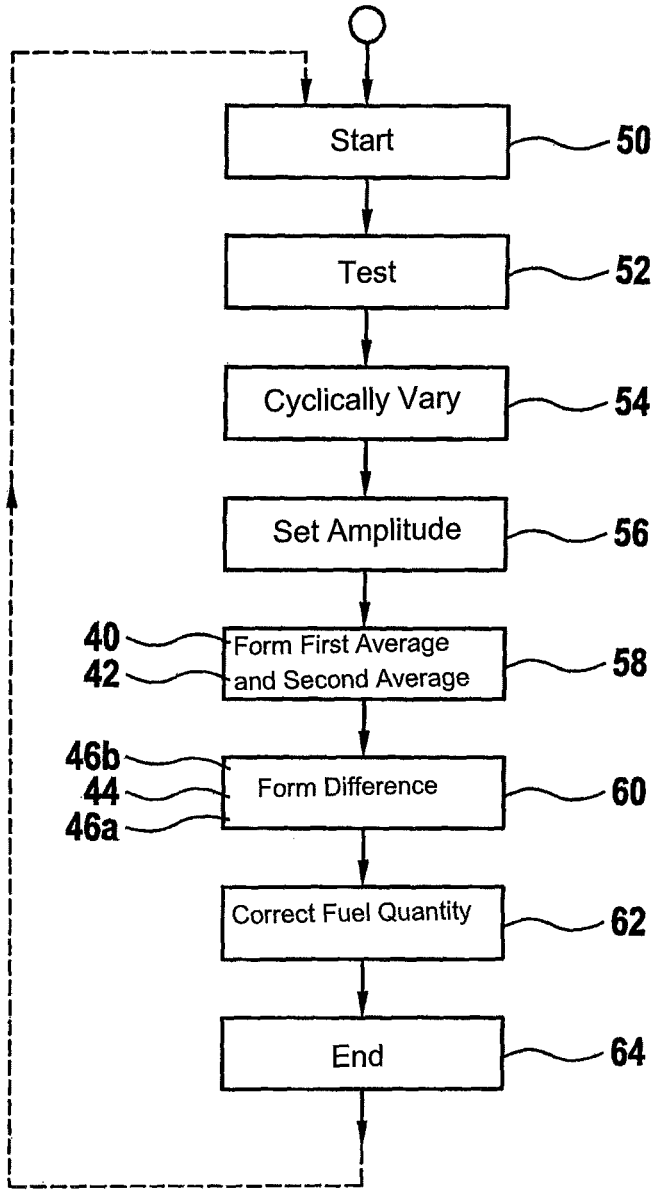
FIG. 5 shows a flow chart for carrying out a method for operating the internal combustion engine.

FIG. 5 shows a flowchart which describes a method for operating internal combustion engine 10. The flowchart is preferably processed using computer program 28 on control and/or regulating device 24 (see FIG. 1). The procedure shown in FIG. 5 begins in a start block 50.

In a following block 52, a test operation is activated for the internal combustion engine. One of cylinders 12*a* to 12*d* is first selected for the method.

In a following block 54, selected cylinder 12 is varied cyclically about a determined lambda value 30. This may take place, for instance, using a suitable stimulation of the above-mentioned control circuit or, provided the control circuit includes a two-position control, perhaps by utilizing a natural control oscillation. In remaining cylinders 12, the mixture composition is meanwhile held constant.

Determined lambda value 30 of selected cylinder 12 and constant lambda value 30 of the remaining cylinders preferably have the value one. In a following block 56, an amplitude of the variation of the mixture composition, characterized by an amplitude of lambda signal 23, is set in the test operation with respect to four-cylinder internal combustion engine 10 to four times the amplitude of a variation of all cylinders 12*a* to 12*d* in a normal operation.

In a subsequent block 58, first unsteady running average value 42 is formed from a plurality of unsteady running values which are associated with a respective phase having a relatively rich mixture composition. In the same way, second unsteady running average value 40 is formed from a plurality of unsteady running values which are associated with a respective phase having a relatively lean mixture composition.

In a following block 60, difference 44 of the two unsteady running average values 40 and 42 is formed. Subsequently, this difference 44 is compared to at least one threshold value 46. From the result of the comparison one may then conclude upon a trimming of the mixture composition in currently selected cylinder 12. In this instance, if difference 44 is less than a lower threshold value 46*a*, one may then conclude upon a selected cylinder 12 trimmed towards rich. Then, correspondingly, if difference 44 is greater than an upper threshold value 46*b*, one may then conclude upon a selected cylinder 12 trimmed towards lean. Threshold values 46*a* and 46*b* are preferably measured as a function of a value of difference 44, which was ascertained in the case of an "untrimmed" cylinder 12.

In a following block 62, the trimming ascertained of selected cylinder 12 is used to correct a fuel quantity that is to be injected and/or an air quantity of selected cylinder 12 of internal combustion engine 10. The correction of the fuel quantity to be injected takes place, for example, by a change in an actuating signal (preferably by the change of an actuating duration) of injector 14 associated with selected cylinder 12 and of an operating device for controlling associated injector 14.

The procedure shown in FIG. 5 ends in an end block 64. Subsequently, the method described in FIG. 5 may be similarly carried out for remaining cylinders 12. In this way, there may take place in a step-wise manner a "coordination" of all cylinders 12*a* to 12*d* of internal combustion engine 10, whereby the operation of internal combustion engine 10 is able to be improved and the exhaust gas values lowered.

What is claimed is:

1. A method for operating an internal combustion engine having a plurality of cylinders in a homogeneous operation, comprising:

in a test operation, while holding a mixture composition constant in remaining cylinders, cyclically varying a mixture composition in a selected cylinder between a first period in which a lambda value of the mixture composition in the selected cylinder is controlled in a positive direction with respect to a predetermined first lambda value and a second period in which the lambda value of the mixture composition in the selected cylinder is controlled in a negative direction with respect to the predetermined first lambda value;

recording values during the cyclical variation;

determining a magnitude of a cyclical fluctuation of the recorded values at transitions between immediately succeeding pairs of the first and second periods; and based on the determined magnitude, determining a trimming of the mixture composition in the selected cylinder.

2. The method as recited in claim 1, wherein the predetermined lambda value is about 1.

3. The method as recited in claim 1, wherein the mixture composition of the remaining cylinders is held constant at the lambda value of 1, in the test operation.

4. The method as recited in claim 1, wherein, in the case of an internal combustion engine that includes a number 'n' of cylinders, the control in the cyclical variation is for varying the mixture composition with a variation amplitude that is 'n' times a variation of all cylinders in a normal operation.

5. The method as recited in claim 1, wherein the trimming ascertained of the selected cylinder is used to correct at least one of a fuel quantity that is to be injected and an air quantity of the selected cylinder of the internal combustion engine.

6. The method as recited in claim 1, wherein the determining of the magnitude of the cyclical fluctuation includes:

in the test operation, forming from the recorded values a first unsteady running average value of a plurality of unsteady running values associated with the second period in which the mixture composition is relatively rich, and forming from the recorded values a second unsteady running average value of a plurality of unsteady running values associated with the first period in which the mixture composition is relatively lean;

forming a difference of the two unsteady running average values; and comparing the difference to at least one threshold value to form a result.

7. The method as recited in claim 6, wherein, if the difference is less than a lower threshold value, the trimming is one that, when applied, trims the selected cylinder towards rich, and, if the difference is greater than an upper threshold value, the trimming is one that, when applied, trims the selected cylinder towards lean.

8. A method for operating an internal combustion engine having a plurality of cylinders in an homogeneous operation in which an exhaust gas lambda value and an unsteady running of the internal combustion engine are recorded and a mixture composition is varied cyclically at least intermittently, the method comprising:

in a test operation, cyclically varying a mixture composition in a selected cylinder about a determined lambda value while holding constant a mixture composition in remaining cylinders;

forming a first unsteady running average value of a plurality of unsteady running values associated with a respective phase of the cyclical variation having a relatively rich mixture composition;

forming a second unsteady running average value of a plurality of unsteady running values associated with a respective phase of the cyclical variation having a relatively lean mixture composition;

forming a difference of the two unsteady running average values;

comparing the difference to at least one threshold value to form a result; and from the result of the comparing, determining a trimming of the mixture composition in the selected cylinder.

9. The method as recited in claim 8, wherein, if the difference is less than a lower threshold value, the trimming is one that, when applied, trims the selected cylinder towards rich, and if the difference is greater than an upper threshold value, the trimming is one that, when applied, trims the selected cylinder towards lean.

10. A non-transitory computer-readable medium on which a computer program is stored, the computer program containing instructions that are executable by a processor and that, when executed by the processor, cause the processor to perform a method for operating an internal combustion engine having a plurality of cylinders in an homogeneous operation, the method comprising:

in a test operation, while holding a mixture composition constant in remaining cylinders, cyclically varying a mixture composition in a selected cylinder between a first period in which a lambda value of the mixture composition in the selected cylinder is controlled in a positive direction with respect to a predetermined first lambda value and a second period in which the lambda value of the mixture composition in the selected cylinder is controlled in a negative direction with respect to the predetermined first lambda value;

recording values during the cyclical variation;

determining a magnitude of a cyclical fluctuation of the recorded values at transitions between immediately succeeding pairs of the first and second periods; and based on the determined magnitude, determining a trimming of the mixture composition in the selected cylinder.

11. A control device for an internal combustion engine, comprising:

processing circuitry; and a non-transitory computer-readable medium on which a computer program is stored, the computer program including instructions that are executable by the processing circuitry and that, when executed by the processing circuitry, cause the processing circuitry to perform a method for operating an internal combustion engine having a plurality of cylinders in an homogeneous operation, the method comprising:

in a test operation, while holding a mixture composition constant in remaining cylinders, cyclically varying a mixture composition in a selected cylinder between a first period in which a lambda value of the mixture composition in the selected cylinder is controlled in a positive direction with respect to a predetermined first lambda value and a second period in which the lambda value of the mixture composition in the selected cylinder is controlled in a negative direction with respect to the predetermined first lambda value;

recording values during the cyclical variation;

determining a magnitude of a cyclical fluctuation of the recorded values at transitions between immediately succeeding pairs of the first and second periods; and based on the determined magnitude, determining a trimming of the mixture composition in the selected cylinder.

* * * * *